US008768538B2

(12) United States Patent
McVicar et al.

(10) Patent No.: US 8,768,538 B2
(45) Date of Patent: Jul. 1, 2014

(54) STRADDLE CARRIER

(75) Inventors: Martin McVicar, County Monaghan (IE); Robert Moffett, County Monaghan (IE)

(73) Assignee: Combilift Research and Development (IE)

( * ) Notice: Subject to any disclaimer, the term of this patent is extended or adjusted under 35 U.S.C. 154(b) by 0 days.

(21) Appl. No.: 13/579,158

(22) PCT Filed: Feb. 17, 2010

(86) PCT No.: PCT/EP2010/051971

§ 371 (c)(1),
(2), (4) Date: Aug. 15, 2012

(87) PCT Pub. No.: WO2011/101024

PCT Pub. Date: Aug. 25, 2011

(65) Prior Publication Data

US 2012/0323408 A1 Dec. 20, 2012

(51) Int. Cl.
*B66C 19/00* (2006.01)

(52) U.S. Cl.
USPC ..... 701/2

(58) Field of Classification Search
USPC ..... 701/2; 414/460
See application file for complete search history.

(56) References Cited

U.S. PATENT DOCUMENTS

| | | | | |
|---|---|---|---|---|
| 3,570,695 | A | 3/1971 | Schwartz et al. | |
| 3,655,081 | A | 4/1972 | Monk | |
| 4,880,124 | A | 11/1989 | Feider et al. | |
| 2007/0110550 | A1 * | 5/2007 | Callens | 414/460 |

FOREIGN PATENT DOCUMENTS

| | | | | |
|---|---|---|---|---|
| EP | 1752410 | A1 * | 2/2007 | B66C 19/00 |

OTHER PUBLICATIONS

International Search Report and Written Opinion dated Nov. 16, 2010 for corresponding PCT application No. PCT/EP2010/051971.

* cited by examiner

*Primary Examiner* — Mary Cheung
*Assistant Examiner* — Anne Mazzara
(74) *Attorney, Agent, or Firm* — Gardner, Linn, Burkhart & Flory, LLP

(57) ABSTRACT

A straddle carrier comprises a frame (10) having opposite substantially parallel sides (12, 14) and which is configured for straddling a container to be lifted and transported between said opposite sides. The carrier has three ground wheels (24, 26) and (28) to enable the frame to be positioned over the container. The ground wheels comprise a first ground wheel (24) disposed at least approximately centrally on one side (12) of the frame, and second and third ground wheels (26, 28) disposed at opposite ends of the other side (14) of the frame. The second and third wheels (26, 28) are steerable by rotation about respective substantially vertical axes (40, 42).

5 Claims, 4 Drawing Sheets

STRADDLE CARRIER

TECHNICAL FIELD

This invention relates to straddle carriers.

BACKGROUND ART

A straddle carrier is a vehicle for use in e.g. port terminals and intermodal yards used for stacking and moving intermodal containers. Straddle carriers pick up and carry containers while straddling their load and, depending upon capacity, they have the ability to stack containers up to four high. They are capable of relatively low speeds (typically up to 30 km/h) with a laden container, and are generally not road-going.

Conventionally, straddle carriers are equipped with four ground wheels. When the carrier is not used on a level surface, a suspension system is required to ensure the four wheels stay in contact with the ground at all times. However, due to cost, the majority of straddle carriers have no suspension system. Without a suspension system a wheel may lose contact with the ground, therefore losing traction and braking and reducing stability.

DISCLOSURE OF THE INVENTION

According to the present invention there is provided a straddle carrier comprising a frame having opposite substantially parallel sides and which is configured for straddling a container to be lifted and transported between said opposite sides, a plurality of ground wheels to enable the frame to be positioned over the container, and means for lifting the container within the frame, wherein the ground wheels comprise a first ground wheel disposed at least approximately centrally on one side of the frame, and second and third ground wheels disposed at or adjacent opposite ends of the other side of the frame, the second and third wheels being steerable by rotation about respective substantially vertical axes.

In a preferred embodiment the first wheel is non-steerable with its rotational axis extending across the width of the frame.

Preferably the second and third wheels are synchronized for steering by substantially equiangular amounts in opposite directions of rotation about their vertical axes.

BRIEF DESCRIPTION OF THE DRAWINGS

An embodiment of the invention will now be described, by way of example, with reference to the accompanying drawings, in which.

DETAILED DESCRIPTION OF PREFERRED EMBODIMENTS

Figure 1:
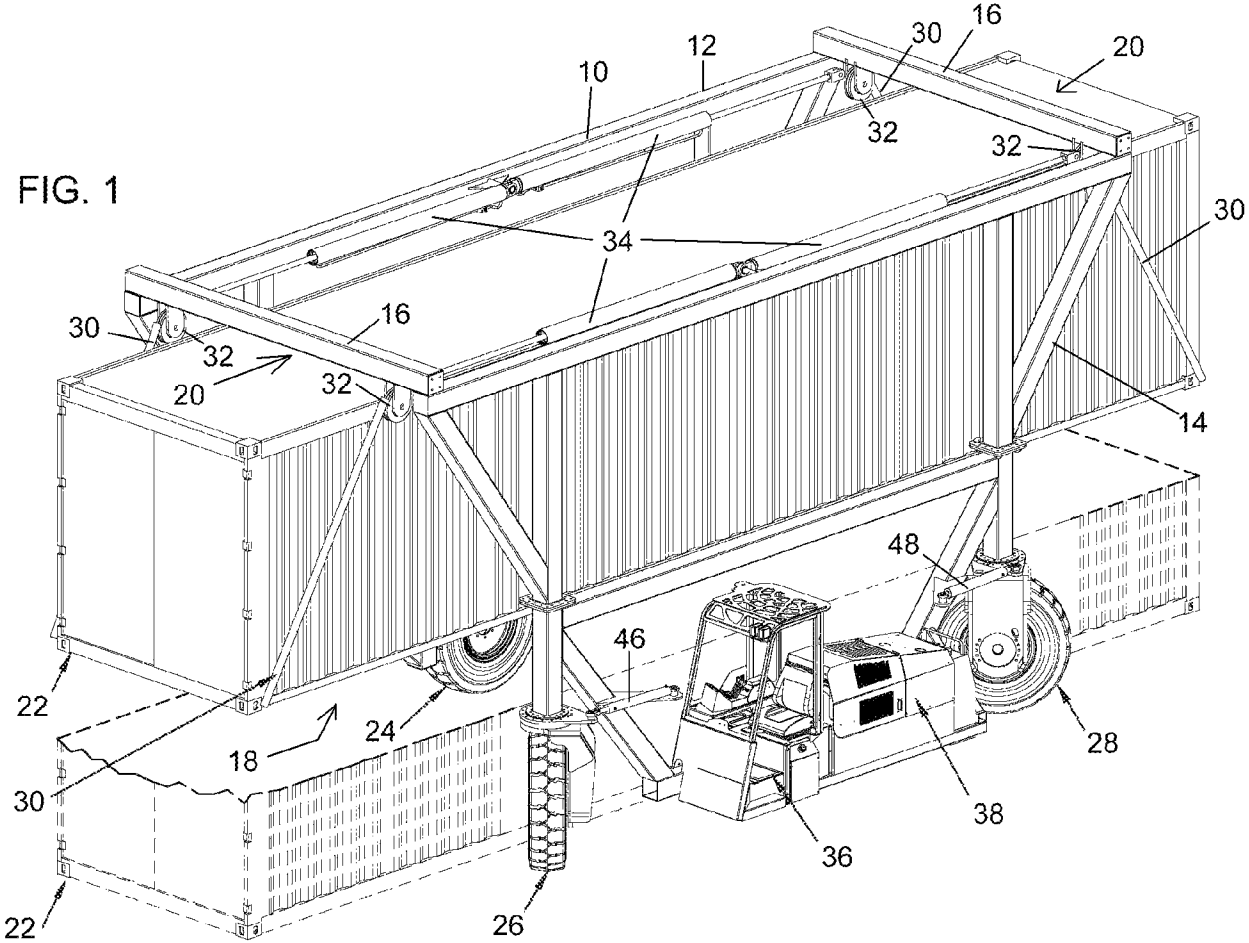
FIG. 1 is a perspective view of a straddle carrier according to the embodiment of the invention.
Figure 3:
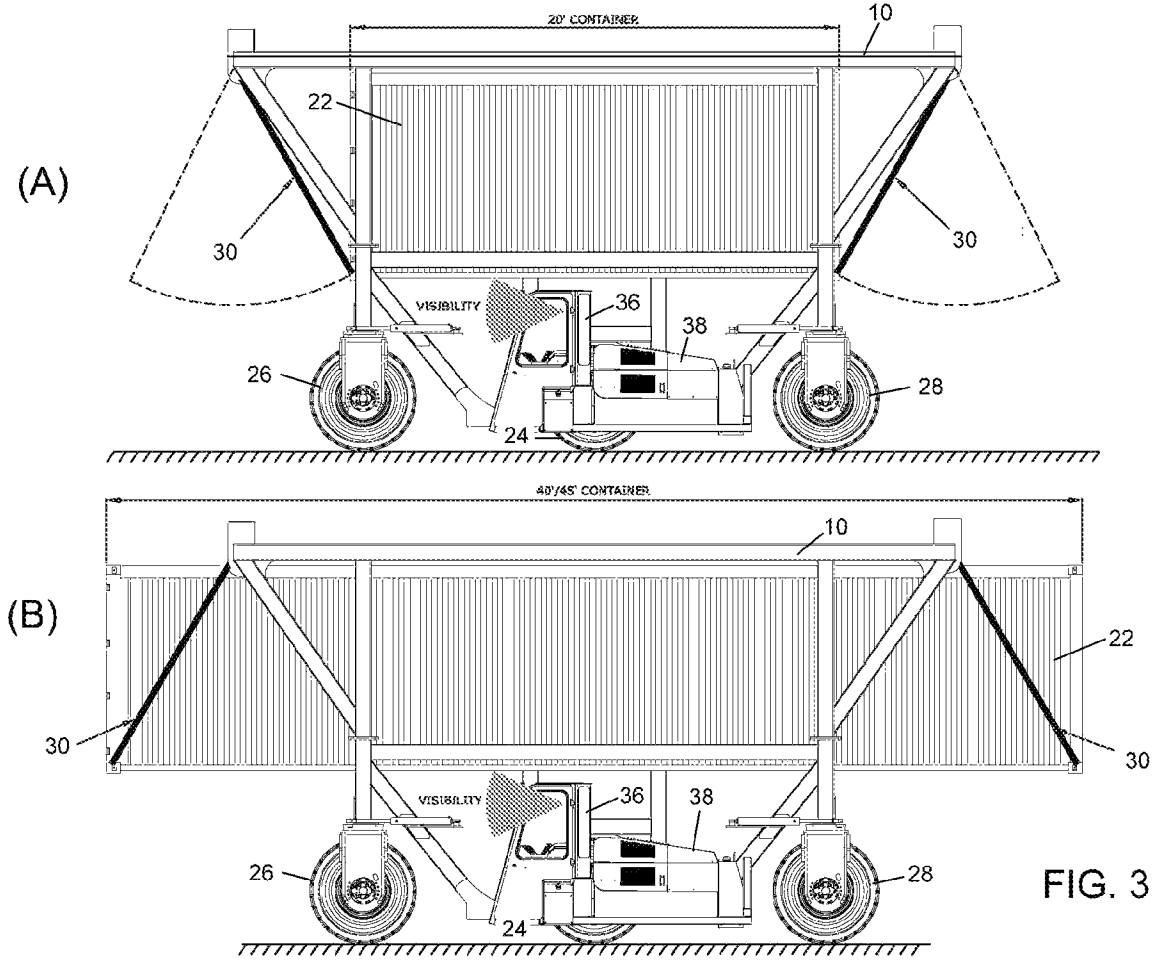
FIGS. 3(A) and (B) are side views showing the carrier lifting loads of different lengths.
Figure 4:
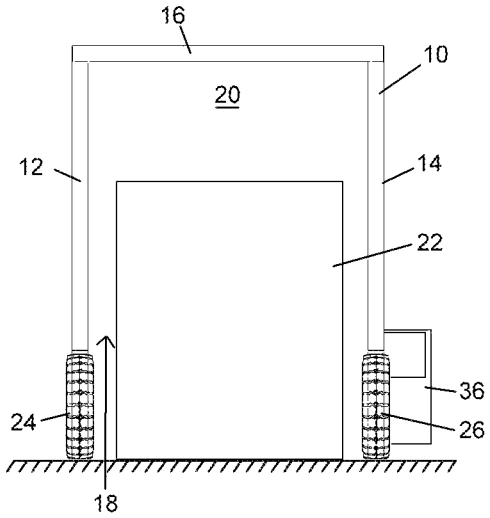
FIG. 4 is a schematic end view of the carrier of FIG. 1.

Referring to the drawings, the straddle carrier comprises a steel frame 10 which, in end view, FIG. 4, is generally in the form of an inverted "U". The frame 10 has opposite substantially parallel sides 12, 14 joined at the top by cross members 16, an open base 18 and opposite open ends 20. This structure forms a kind of tunnel which allows the frame to straddle a container 22 to be lifted and transported. In FIG. 1 (dashed lines) and in FIG. 4 the container 22 is shown on the ground, while in FIG. 1 (solid lines) and in FIG. 3 the container 22 is shown lifted within the frame. The frame 10 is mounted on three ground-wheels 24, 26 and 28 to allow the frame to be driven over the container 22 while the latter is resting on the ground, as shown in FIG. 4. The construction and operation of the wheels 24-28 will be described in more detail below.

The container 22 is attached to the frame by four flexible steel members 30, e.g. chains or cables. In use, one end of each member 30 is attached to a respective bottom corner of the container 22 and the member 30 passes over a respective pulley 32 at the top of the frame 10 where its other end is attached to one end of a respective hydraulic cylinder 34. By retracting the cylinders 34 the container 22 can be lifted off the ground for transport, FIGS. 1 and 3, and by extending the cylinders the container can be lowered to the ground once again, FIGS. 1 and 4 (the members 30 are not shown in FIG. 4).

Since the flexible members 30 can be swung over an angle shown in dashed lines in FIG. 3(A), they can be connected to different lengths of container 22, as shown in FIGS. 3(A) and 3(*b*), so that the carrier is capable of lifting and transporting loads of different lengths. The straddle carrier is also capable of lifting the container on and off haulage vehicles, or stacking them two or more high provided the internal clearance height of the frame 10 is sufficient to raise the container to the required height. For transportation, the container 22 can be lifted right to the top of the frame 10 where it is held tight against the underside of the cross members 16. This secures and stabilises the container.

The straddle carrier is operated by an operator seated in a cabin 36 mounted on the outside of the frame 10, between the wheels 26, 28. Behind the cabin 36 is a hydraulic power unit 38 which, under operator control, supplies hydraulic power to the cylinders 34 via a hydraulic circuit, not shown. The operator in the cabin 36 is able to raise and lower the container 22 by contracting and extending the cylinders 34 in known manner. The container 22 can be lifted high enough for the operator to have good visibility underneath it—see FIG. 3.

The straddle carrier's ground wheels comprise a single wheel 24 which is disposed below the side 12 at least approximately centrally between the opposite open ends 20 of the frame 10, and two wheels 26, 28 which are disposed below the side 14 respectively at or adjacent the opposite open ends of the frame. The three wheels lie approximately on an equilateral triangle whose apex is at the wheel 24 and whose base extends between the wheels 26 and 28. The wheel 24 is fixed, i.e. it is non-steerable, its rotational axis X (FIG. 3) extending across the width of the frame perpendicular to the sides 12, 14. However, each of the wheels 26, 28 is steerable by rotation about respective substantially vertical axes 40 and 42.

The steering of the wheels 26, 28 is synchronized such that under the control of an operator's steering wheel 44 in the cabin 36 the wheels 26, 28 rotate about their vertical axes 40, 42 by substantially equiangular amounts in mutually opposite directions of rotation. The rotation of the steerable wheels 26, 28 about their vertical axes is effected by hydraulic cylinders 46, 48 which are connected to the hydraulic power unit 38 and controlled by the steering wheel 44. The direction and amount by which the steering wheel 44 is turned determines the direction in which the wheels 26, 28 are rotated about their vertical axes, and through what angle.

In addition to the hydraulic circuits necessary to operate the lifting cylinders 34 and steering cylinders 46 and 48, the carrier also includes a hydraulic circuit connected to one or more hydraulic drive motors associated respectively with one or more of the wheels 24-28 to allow the carrier to be driven over the ground under operator control. The hydraulic motor (s) and drive circuitry is not shown, but the manner of its implementation will be readily known to the skilled man.

Figure 2:
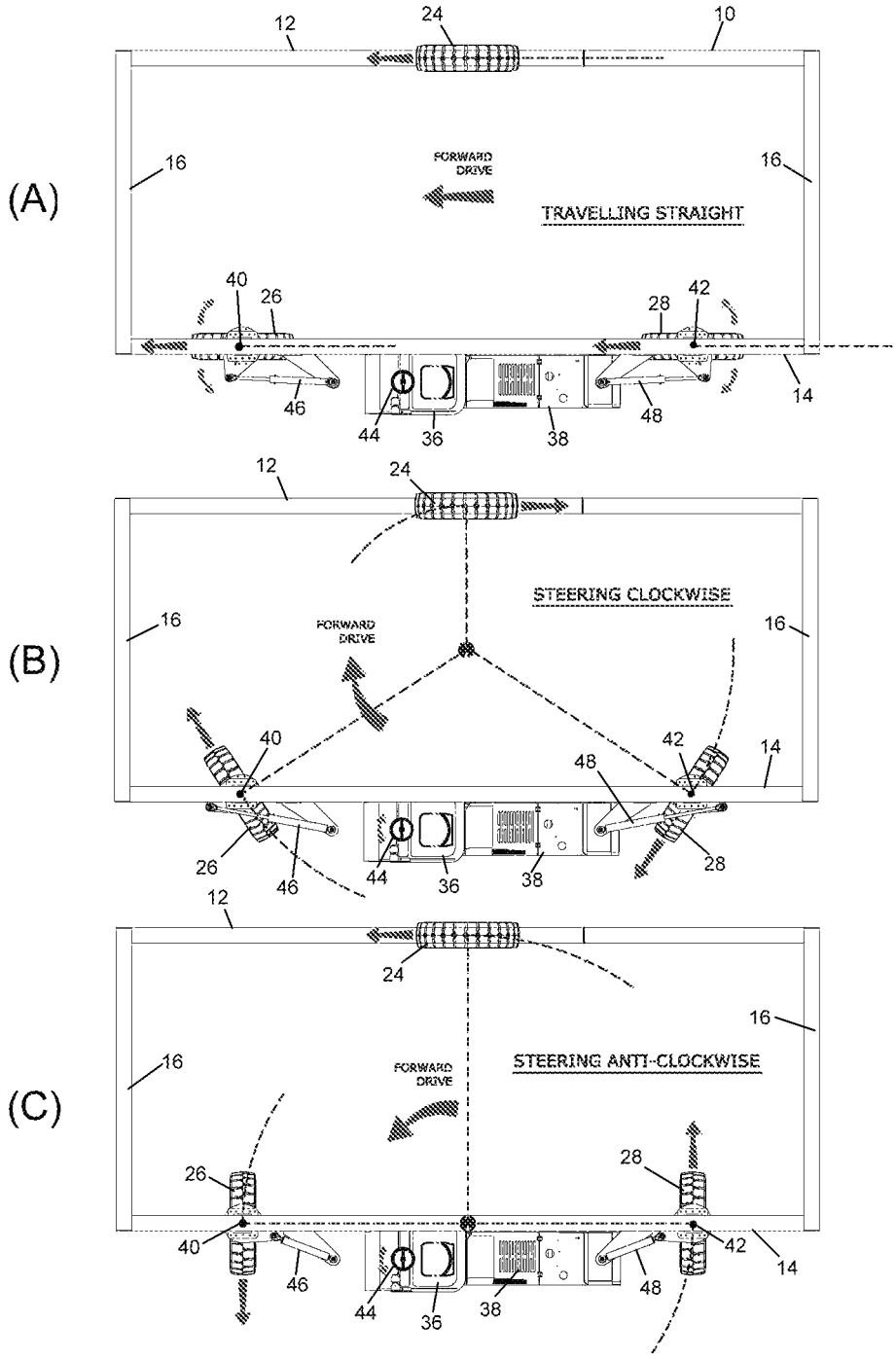
FIGS. 2(A) to (C) are schematic top views of the carrier of FIG. 1 showing steering in various directions.

Referring to FIG. 2, when driving forward straight ahead, FIG. 2(A), all three wheels are aligned parallel to the sides 12, 14. When driving forward and the operator turns the steering wheel 44 clockwise, the straddle carrier steers clockwise, FIG. 2(B), the wheels 26, 28 turning in mutually opposite directions by equal angles. When driving forward and the operator turns the steering wheel 44 anti-clockwise, the straddle carrier steers anti-clockwise, FIG. 2(C) the wheels 26, 28 again turning in mutually opposite directions by equal angles (although in this case the direction of rotation of each wheel is opposite that for clockwise steering). At the extreme limits of steering, which are the wheel positions shown in FIGS. 2(B) and 2(C), the carrier can turn within its own circle.

In a modification of the above embodiment one or more of the wheels 24, 26 and 28 may comprises one of a pair of wheels disposed coaxially side-by-side, the pair of wheels being driven and/or steered as a single unit.

In another modification the operator's cabin could be removed and the straddle carrier controlled remotely.

Although in the foregoing embodiment the ground wheels are driven by hydraulic motors (not shown) and steered by hydraulic cylinders 46 and 48, and the flexible steel lifting members 30 are operated by hydraulic cylinders 34, all powered from the hydraulic power unit 38, any or all of these mechanisms could alternatively be operated by electric motors powered by heavy duty rechargeable batteries in the unit 38.

The three main advantages of the three-wheel straddle carrier described above are:

1. No suspension system is required. All three wheels will remain in contact with the ground irrespective of the terrain.
2. Traction and braking are maintained. All three wheels will remain in contact with the ground irrespective of the terrain, therefore none of the wheels will lose traction or braking.
3. The carrier is more maneuverable. The straddle and its load can turn within its own circle.

The invention is not limited to the embodiments described herein which may be modified or varied without departing from the scope of the invention.

The invention claimed is:

1. A straddle carrier comprising:

a frame having opposite substantially parallel sides and which is configured for straddling a container to be lifted and transported between said opposite sides, a plurality of ground wheels to enable the frame to be positioned over the container, and means for lifting the container within the frame, wherein the plurality of ground wheels consist of first, second and third ground wheel assemblies, each said ground wheel assembly being selected from a single wheel and a pair of wheels disposed coaxially side-by-side, wherein the first ground wheel assembly is disposed at a first position at least approximately centrally on one side of the frame, and the second and third ground wheel assemblies are disposed respectively at second and third positions which are at or adjacent opposite ends of the other side of the frame, the second and third wheels being steerable by rotation about respective substantially vertical axes, wherein the straddle carrier is completely supported by contact with the ground at said first, second and third positions.

2. A straddle carrier as claimed in claim 1, wherein the first wheel is non-steerable with its rotational axis extending across the width of the frame.

3. A straddle carrier as claimed in claim 1, wherein the second and third wheels are synchronized for steering by substantially equiangular amounts in opposite directions of rotation about their vertical axes.

4. A straddle carrier as claimed in claim 1, wherein the internal clearance height of the frame is sufficient to allow stacking of containers at least two high.

5. A straddle carrier as claimed in claim 1, wherein the straddle carrier is operable by remote control.

* * * * *